United States Patent [19]

von Beckmann et al.

[11] Patent Number: 4,658,730

[45] Date of Patent: Apr. 21, 1987

[54] RAILROAD CORRECTION APPARATUS

[75] Inventors: Helmuth von Beckmann, Columbia; Edwin H. Reeves, Blythewood, both of S.C.

[73] Assignee: Canron Corp., West Columbia, S.C.

[21] Appl. No.: 882,011

[22] Filed: Jul. 3, 1986

Related U.S. Application Data

[63] Continuation of Ser. No. 566,387, Dec. 28, 1983, abandoned.

[51] Int. Cl.[4] ..... E01B 33/02

[52] U.S. Cl. ..... 104/8; 33/1 Q; 33/287; 104/7.2

[58] Field of Search ..... 104/7 B, 8; 33/1 Q, 33/287; 73/146

[56] References Cited

U.S. PATENT DOCUMENTS

| | | | |
|---|---|---|---|
| 3,298,105 | 1/1967 | Stewart et al. | 33/287 |
| 3,411,455 | 11/1968 | Stewart et al. | 104/7 B |
| 3,494,298 | 2/1970 | Glasser | 104/8 |
| 3,545,384 | 12/1970 | Plasser et al. | 104/7 B |
| 3,604,360 | 9/1971 | Stewart et al. | 104/8 |
| 3,605,625 | 9/1971 | Benesics | 104/8 |
| 3,875,865 | 4/1975 | Plasser et al. | 104/8 X |
| 3,922,969 | 12/1975 | Tyler et al. | 104/8 |
| 4,166,291 | 8/1979 | Shupe | 364/560 |
| 4,176,456 | 12/1979 | von Beckmann | 33/1 Q |
| 4,184,266 | 1/1980 | Hurni | 33/287 |

*Primary Examiner*—Randolph A. Reese

*Attorney, Agent, or Firm*—Wenderoth, Lind & Ponack

[57] ABSTRACT

Apparatus for continuously surveying and aligning railroad track has a measuring system with a leading point and a trailing point, both points being on the track center line. Two tensioned wires extend between these points, respectively, and a common intermediate point also on the track center line. At the trailing point a shadow board is located and this is arranged to interrupt an infrared beam extending between a projector at the leading point and a receiver behind the trailing point. A device measures continuously the angle between the two wires and this value is averaged and then subjected to mathematical manipulation in a computing device to derive an ordinate value for the shadow board which is automatically extended accordingly. The receiver then commands a track correction ram located adjacent the shadow board to move the track radially inwardly or outwardly until alignment between projector, receiver and shadow board causes the receiver to stop the lining action.

10 Claims, 2 Drawing Figures

RAILROAD CORRECTION APPARATUS

This application is a continuation, of now abandoned application Ser. No. 566,387, filed Dec. 28, 1983, now abandoned.

BACKGROUND OF THE INVENTION

This invention relates to apparatus for continuously surveying and aligning railroad track.

One well-established technique, described in U.S. Pat. No. 3,411,455, Stewart and von Beckmann, involves the use of an infrared beam transmitter, two infrared receivers and two shadow boards. The transmitter typically is mounted on a self-propelled front rail engaging buggy, both receivers are mounted on a rear rail engaging buggy and one shadow board is mounted on a self-propelled jacking car positioned much nearer to the rear buggy than to the front buggy and arranged to tow the rear buggy. The other shadow board is mounted on a further buggy closely positioned in front of the jacking car and arranged to be pushed by the jacking car.

The transmitter together with the last mentioned shadow board (reference) and one of the receivers operate as a reference system to establish a reference line and the first mentioned shadow board (detecting) together with the other receiver operate as a detection system to detect the track condition relative to the reference line. More particularly, the reference line is established by moving the reference shadow board transversely outwardly to interrupt the beam from the transmitter to the reference receiver. The reference receiver and the detection receiver are mounted for conjoint movement and they also can be moved transversely so as to vary the ratio of the distance the reference shadow board projects transversely from the track to the distance the receivers extend transversely according to whether the alignment apparatus is operating on straight (tangent) track where this ratio is a fixed constant, circular track where the ratio is a different fixed constant and spiral track where the ratio varies continuously. In a practical example of the prior system only one receiver is used, the system being switched from a "detecting" mode to an "aligning" mode. For this purpose the two shadow boards have flip away edges permitting only the appropriate shadow board to work with the receiver at any one time. In any event, a human operator has to decide what type of track is being operated on.

The detection system indicates when the track at the working station, where the detection shadow board is located, is out of alignment with the reference line. More particularly if the detection shadow board blocks the beam from the transmitter to the detection receiver or single receiver, the receiver signals a jack on the jacking car to move the track a sufficient distance to permit the receiver to "see" the beam.

One disadvantage of such a system is that it requires a human operator to make decisions based on judgment and expertise in order to arrive at a preadjustment of the apparatus.

Other systems which overcome this disadvantage have been proposed. For example U.S. Pat. No. 4,176,456, Helmuth von Beckmann, describes a system in which, instead of a shadow board technique, two overlapping mechanical chords, which may be wires or rods, are provided. A first measuring device is located at a predetermined point on one of the chords and measures the lateral distance of that point on the one chord from the track centre line. Processing circuitry is arranged to sum and average distance values sampled at ten or so consecutive points each spaced apart two meters or so such that a running mean track position value or reference is obtained.

A second measuring device is located at another predetermined point on the other chord and measures the lateral distance of that point from the track center line. The value obtained is compared with the mean value or reference obtained from the processing circuitry and any difference or error causes a track correcting device located adjacent the second measuring device to move the track rightwards or leftwards to reduce the error.

U.S. Pat. No. 4,166,291, Charles Shupe, describes a similar system in which three mechanical chords are used instead of two and the measuring devices measure the angles between each successive pair of chords rather than offset from the chords. The principle is otherwise the same as that taught in U.S. Pat. No. 4,176,456.

Both of the latter two described systems suffer from the disadvantage that a wire or rod serving as a mechanical chord passes by the position at which the track correcting machinery is located tending to obstruct proper operation of the correcting machinery or damage to the chord. This is particularly true if an attempt is made to operate in switches where the correcting machinery has to move laterally in order to cover a branch line track.

SUMMARY OF THE INVENTION

It is an object of the present invention to overcome this disadvantage.

Broadly the invention overcomes the disadvantages of the prior art by combining in one system two different types of measuring systems. The first measuring system involves the use of physical member(s) forming chord(s) and a device cooperating with the physical member(s) to derive a signal indicative of the track geometric condition. The value of this signal can be averaged to obtain a desired value. The second measuring system does not use a physical reference member but an infrared beam with which a shadow board cooperates. The shadow board is extended a value determined by the previously obtained average value. The track is then connected at the shadow board such that the edge of the shadow board just blocks the beam. The use of a beam rather than a physical member for the second reference chord prevents obstruction of the operation of the track correction machinery. Of course, instead of infrared, a visible light beam could be used.

Preferably two physical members are used, for example rods or tensioned wires, and the angle between them is measured in which case an ordinate value has to be computed from the angle using trigonometric principles.

DESCRIPTION OF THE PREFERRED EMBODIMENT

Figure 1:
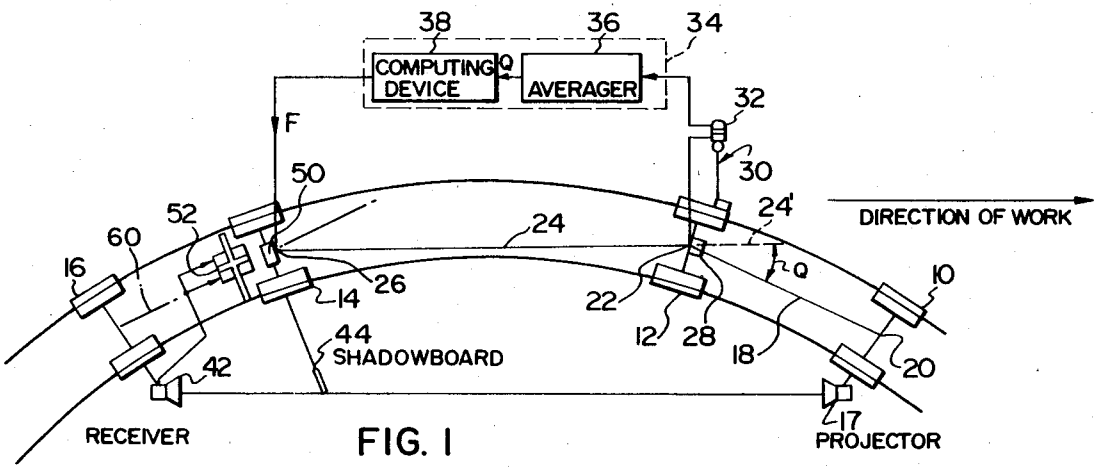
FIG. 1 illustrates diagrammatically an exemplary embodiment of a track position error and realigning apparatus according to the invention.

Referring firstly to FIG. 1, four rail engaging buggies 10, 12, 14 and 16 are shown. Buggy 10 is the lead buggy and thus carries a laterally offset infrared transmitter 17 aligned to transmit radiation back along the track. The front end of a first chord formed as a stiff rod (or tensioned wire) 18 is hinged to the buggy 10 at point 20. The rear end of rod 18 is hingedly connected to following buggy 12 at point 22. Also hingedly connected at point 22 is the front end of a second chord formed as a stiff rod (or tensioned wire) 24 the rear end of which is hingedly connected to point 26 on buggy 14.

An angle measuring device 28, which may for example be of the type described in aforementioned U.S. Pat. No. 4,166,291, the disclosure of which is incorporated herein by reference, is also mounted on buggy 12 so as to measure the angle Q between rod 18 and the extension 24' of rod 24. Angle measuring device 28 derives an analog voltage the value of which is dependent on the size of angle Q and is operated in conjunction with a distance measuring device shown schematically at 30 such that at convenient intervals along the track, for example every two meters, the analog voltage may be sampled using a sampling circuit shown schematically at 32.

The analog voltage is passed to a microprocessor 34 for processing. This may include an averaging apparatus 36 and a computing device 38. The averaging apparatus 36 is designed to receive the analog voltages samples at a predetermined number of consecutive points, sum them and obtain a mean track position value over the distance travelled. The apparatus 36 may conveniently include an analog to digital converter, the digital values being summed and divided by the number of samples. As the apparatus traverses the track the first of the predetermined number of samples is dropped and a new sample is added to the remaining ones and in this way a running average is obtained every two meters, for example.

Rear buggy 16, at the rear end of a third chord 60, which is actually only an imaginary line along the apparatus, carries a laterally offset infrared receiver 42 which faces generally down the track to receive infrared radiation from transmitter 16. A shadow board 44 is carried by buggy 14 and projects laterally in a direction towards the beam from transmitter 16 to receiver 42.

Track correcting means 52, which can be any suitable device for shifting track laterally as is known in the art and typically including a double acting jack, is positioned on buggy 14 as close as practicable to shadow board 44 so that correction of the track occurs as near as possible to point 26. Receiver 42 is connected so as to control the operation of track correcting jack 52 in a manner conventional in the art. More particularly, when receiver 42 receives infrared energy from projector 17 it causes jack 52 to operate in a radially inwardly direction and when receiver 42 does not receive infrared energy it causes jack 52 to operate to move the track in a radially outwardly direction.

The signal representing the mean value of angle Q which is derived by averager 36 is fed into the computing device 38 in which is derived a signal representing a distance F which, for circular tracks, is the desired radial distance from the track center line at point 26 to the long chord formed by the infrared radiation beam extending between transmitter 17 and receiver 42.

The signal representing F is fed into a shadow board drive circuit, shown schematically at 50, which includes a drive motor (not specifically illustrated) for driving the shadow board 44 radially to a point where the distance from its tip to point 26 is F. The drive circuit 50 includes means for measuring automatically the distance F and stopping the drive motor when this distance is reached. One such means might involve measuring the rotation of gearing associated with the drive motor.

With the shadow board 44 in the correct position to define the correct distance F, the shadow board will interrupt or block the infrared beam from projector to receiver if the actual shape of the curved track is too "flat" at point 26 and will be free of the beam if the actual shape of the track at point 26 is too "curved". Assuming the second condition is present, initially light is received by receiver 42 so that the receiver commands track correction jack 52 to move the track radially inwardly at point 26 (actually, close to point 26) until the shadow board 44, which is of course being carried radially inwardly with the track, blocks the infrared beam at which point the jack is stopped and the track correction at point 26 is completed.

Assuming, on the other hand, the first track condition outlined above in which the infrared beam is blocked by shadow board 44, receiver 42 commands the track correction jack to move the track radially outwardly at point 26 until receiver 42 "sees" the infrared beam. Then receiver 42 commands jack 52 to move the track radially inwardly until the beam is again blocked at which point jack 52 stops and the track correction action at point 26 is completed.

Figure 2:
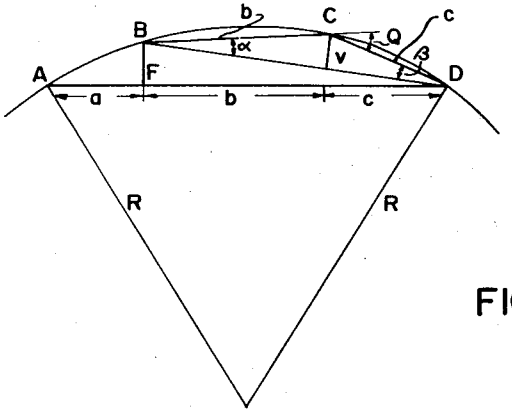
FIG. 2 is a geometric diagram for use in explaining the derivation of a mathematical equation forming the basis of the measuring technique used in the apparatus of FIG. 1.

Reference will now be made to FIG. 2 to explain how the angle Q, which is the angle between chords 18 and 24, is related to the distance F which is the radial distance from the track center line at point 26 to the long chord formed by the infrared radiation beam extending between transmitter 16 and receiver 42.

In FIG. 2 the curved line of approximate radius R represents the track section shown in FIG. 1. Point A corresponds to the location of receiver 42, point B coincides with point 26 in FIG. 1, point C coincides with point 22 in FIG. 1 and point D represents the location of transmitter 17. Chords b and c correspond, respectively, to rods 24 and 18 of FIG. 1 and the long chord joining A and D corresponds to the infrared beam. The ordinate from point B to this long chord is referenced F and corresponds to the lateral extension of shadow board 44. Ordinate F intersects the long chord to define a first portion of length a.

A line joining B and D is drawn and a line V drawn from point c intersects line BD at right angles. The extension of line V intersects the long chord to define a second portion of length approximately equal to b and a third portion of length equal to C.

In the field of large radii railway curves, the following mathematical derivations and relations include approximations which have a negligible effect on the values obtained.

Using established geometrical principles, angle Q $=\alpha+\beta$ where Q is the exterior angle of Triangle BDC and $\alpha$ and $\beta$ are the two interior opposite angles.

$$\tan Q = \tan(\alpha + \beta)$$

$$= \frac{\tan\alpha + \tan\beta}{1 - \tan\alpha\tan\beta}$$

-continued $$= \frac{\frac{V}{b} + \frac{V}{c}}{1 - \frac{V}{b} \cdot \frac{V}{c}}$$

which reduces to $$\frac{V(b+c)}{bc - V^2} \therefore V^2 \tan Q + V(b+c) - bc \tan Q = 0$$

The above equation is in the form of $ax^2+bx+c=0$ which can be solved using $$x = \frac{-b \pm \sqrt{b^2 - 4ac}}{2a} \therefore$$

$$V = \frac{-(c+b) \pm \sqrt{(c+b)^2 + 4\tan Q \cdot (bc\tan Q)}}{2\tan Q}$$

Let $K_1 = -(c+b)$, $K_2 = (c+b)^2$, $K_3 = 4bc$

Thus, expressing V as a function of Q gives $$V(Q) = \frac{K_1 + \sqrt{K_2 + K_3 \tan^2 Q}}{2\tan Q} \quad 1$$

From the known relationship of versine, chord lengths and radius of curvature $$V = \frac{bc}{2R} \text{ and } F = \frac{a(b+c)}{2R}$$

which reduces to $$R = \frac{bc}{2V} \text{ and } R = \frac{a(b+c)}{2F}$$

Equating these two expressions gives $$\frac{bc}{2V} = \frac{a(b+c)}{2F}$$

Solving for F and expressing it as a function of Q gives $$F(Q) = \frac{a(b+c)}{bc} V(Q) \quad 2$$

If a=c we have $$F(Q) = \left(1 + \frac{a}{b}\right) V(Q) \quad 3$$

substituting V(Q) from equation (1) gives $$F(Q) = \left(1 + \frac{a}{b}\right) \frac{K_1 + \sqrt{K_2 + K_3 + \tan^2 Q}}{2\tan Q} \quad 4$$

The above equation establishes the relationship that should occur between the angle Q measured on the track and the value F for a circular section of track. Computing device 38 is, of course, programmed to derive an output signal F from an input signal Q according to equation (4).

In a practical embodiment of the invention the chord segments a, b and c were chosen, respectively, as 13 feet, 75 feet and 13 feet but the values are merely exemplary and chord segments a and c do not need to be identical to each other.

The present invention is specifically described as embodying, in combination with a shadow board system, an angle measuring system as shown per se in above mentioned U.S. Pat. No. 4,166,291 and for that reason it uses two chords b and c. However, it is also envisaged that, instead of that angle measuring system, a system measuring the ordinate with respect to a single chord (rod or tensioned wire) as shown per se in above mentioned U.S. Pat. No. 4,176,456, the disclosure of which is incorporated herein by reference, could be combined with the shadow board system. In that case it would not be necessary to convert an angle to an ordinate and so the computation of F would be simpler.

Although, in the system described with reference to the drawings the shadow board 44 is moved firstly a distance F and then the receiver 42 commands track correcting jack 52 to move the track in a direction such that the shadow board 44 just blocks the infrared beam it is envisaged that other techniques using the basic system described could be used to achieve the correct action of jack 52. For example, instead of the shadow board 44 being moved the desired distance initially, the shadow board could be driven initially to just block the beam to derive a position signal which is then compared with the value F to obtain an error signal which error signal could then cause appropriate operation of jack 52.

Although the projector 17 is shown virtually coincident with leading point 20 this is not essential. Projector 17 could be located forwardly or rearwardly of point 20 and new relationships between F and Q derived as appropriate.

The invention as described herein could be combined with a track levelling system of the type disclosed in U.S. Pat. No. 3,298,105 (Stewart et al) in which two infrared projectors cooperate with two separate receivers positioned about 8 feet above respective rails. This prior system uses two vertically adjustable shadow boards the upper horizontal edges of which are arranged to interrupt the beam impinging on the respective receivers. The disclosure of U.S. Pat. No. 3,298,105 is incorporated herein by reference. In the combined system one of the two projectors could be used for the aligning system of the present invention but a separate receiver 42 and shadow board 44 for the aligning system of the present invention would be necessary. (Alternatively, instead of a separate receiver, one of the two receivers could also be used for the aligning action provided it is able to distinguish between the different signals received.) The separate receiver 42 would be located proximate the other two receivers at approximately the same height and shadow board 44 could be mounted for horizontal movement directly on one of the other shadow boards. Measurement of angle Q would be made as described in the principal embodiment, value F computed and shadow board 44 extended and the track corrected as described above.

A variation of the combination described in the preceding paragraph could be a single projector 17 above the track working with a single receiver 42 in the center of the track similar to the levelling system disclosed in U.S. Pat. No. 4,184,266 (Hurni) the disclosure of which is hereby incorporated by reference. The single shadow board used in the Hurni System could be adapted so that, in an alignment mode, it could be moved horizontally a distance F to cut off by means of a vertical edge the infrared beam. Such an adaptation could, for example, involve the use of means for rotating the existing levelling shadow board by 90° to bring it into an aligning mode.

Finally, in addition to the aligning operation described, the averaged value of Q could be used also to determine the desired superelevation of one rail compared to the other as discussed in above mentioned U.S. Pat. No. 4,166,291.

We claim:

1. Track mounted apparatus for aligning railroad track, particularly curved track, comprising a first measuring system having a leading point on the track, an intermediate point on the track and a trailing point on the track and a first straight line physical reference member extending along a first chord between the leading point and the intermediate point and a second straight line physical reference member extending along a second chord between the intermediate point and the trailing point, a measuring means located between said leading and trailing points for measuring the angle between said reference members, means to move said first measuring system over a section of track and to measure a series of said angles to store them and average them thereby providing an averaged angle value; a track correcting means attached to and trailing said first measuring system, a track location sensing system for sensing track position values proximate the location of the track correcting means, the track location sensing system comprising a transmitter and receiver establishing a high frequency electromagnetic beam extending between two longitudinally spaced points on the track on either side of the track correcting means, the first longitudinally spaced point being forward of the point at which the angles are measured and the second longitudinally spaced point being substantially at the end of a third chord extending rearwardly from said trailing point, and a shadow board provided on a rail mounted car located proximate the location of the track correcting means, means for converting the averaged angle value to an equivalent desired radial distance from the track to the beam at the location of the shadow board, means for moving the shadow board radially towards the beam to sense the radial distance from the track to the electromagnetic beam at the location of the shadow board, and means for controlling the operation of the track position correcting means in a sense such that the radial distance of the track sensed by the shadow board substantially equals the desired radial distance thereby correcting the track alignment.

2. Apparatus according to claim 1, wherein the shadow board is located substantially at the trailing point of the first measuring system and one of the two points between which the electromagnetic beam extends coincides substantially with the leading point of the first measuring system.

3. Apparatus according to claim 1 in which said converting means comprises means for converting the averaged position angle value to an ordinate value which approximates the desired radial distance.

4. Apparatus according to claim 3 wherein the shadow board is located substantially at the trailing point of the first measuring system and one of the two points between which the electromagnetic beam extends coincides substantially with the leading point of the first measuring system.

5. Apparatus according to claim 3 in which the shadow board is arranged to move initially radially toward the electromagnetic beam an amount determined by the desired radial distance and wherein the receiver comprises means for subsequently controlling the operation of the track position correcting means until the shadow board is just in alignment with the beam.

6. Apparatus according to claim 1 in which there is a single straight line physical reference member extending between the leading and trailing points on the track and the measuring means comprises means for measuring the perpendicular distance from the member to the track, the converting means comprising means for converting the averaged perpendicular distance value to an ordinate value which approximates the desired radial distance.

7. Apparatus according to claim 6 wherein the shadow board is located substantially at the trailing point of the first measuring system and one of the two points between which the electromagnetic beam extends coincides substantially with the leading point of the first measuring system.

8. Apparatus according to claim 6 in which the shadow board is arranged to move initially radially towards the electromagnetic beam an amount determined by the desired radial distance and wherein the receiver subsequently controls the operation of the track position correcting means until the shadow board is just in alignment with the beam.

9. Apparatus according to claim 1 in which the shadow board is arranged to move initially radially toward the electromagnetic beam an amount determined by the desired radial distance and wherein the receiver subsequently controls the operation of the track position correcting means until the shadow board is just in alignment with the beam.

10. Apparatus according to claim 1 in which the shadow board is arranged to move initially radially toward the electromagnetic beam until the shadow board just blocks the beam to obtain the radial distance of the track and including means for comparing this radial distance with the desired radial distance to obtain an error signal and wherein the receiver comprises means for subsequently controlling the operation of the track position correcting means in response to the error signal.

* * * * *